US008006606B1

(12) United States Patent
Petrosillo et al.

(10) Patent No.: US 8,006,606 B1
(45) Date of Patent: Aug. 30, 2011

(54) FOLDING PROTECTIVE SHIELDS

(75) Inventors: Frank Petrosillo, West Milford, NJ (US); Daniel Gennarelli, East Hanover, NJ (US); Louis Campanile, Denville, NJ (US); Chad Young, Macomb, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 57 days.

(21) Appl. No.: 12/652,844

(22) Filed: Jan. 6, 2010

(51) Int. Cl.
*F41H 7/00* (2006.01)

(52) U.S. Cl. ..... 89/36.07; 89/36.08; 89/36.09

(58) Field of Classification Search ..... 89/36.01, 89/36.02, 36.07, 36.08, 36.09
See application file for complete search history.

(56) References Cited

U.S. PATENT DOCUMENTS

| | | | | |
|---|---|---|---|---|
| 3,590,685 | A * | 7/1971 | Lane | 89/36.09 |
| 4,358,984 | A * | 11/1982 | Winblad | 89/36.08 |
| 6,691,601 | B2 * | 2/2004 | Cohen et al. | 89/36.05 |
| 7,533,600 | B2 * | 5/2009 | Marqueling | 89/36.09 |
| 2009/0044695 | A1 * | 2/2009 | Benjamin et al. | 89/36.08 |

* cited by examiner

*Primary Examiner* — J. Woodrow Eldred
(74) *Attorney, Agent, or Firm* — John F. Moran

(57) ABSTRACT

A protective folding shield for mounting to a rail of a vehicle may include a generally rectangular shield; a base stand fixed to a first side of the shield; a shim fixed to the first side of the shield and spaced apart from the base stand; a hinge fixed to the base stand and the shim; a base fixed to the base stand; a pair of latch bases fixed to the base adjacent a second side of the shield; a pair of latch uprights fixed to the second side of the shield wherein, in a substantially vertical position of the generally rectangular shield, the pair of latch uprights are removably fixed to respective ones of the latch bases; and a plurality of clamps fixed to the base wherein the rail is disposed between the clamps and the base.

20 Claims, 10 Drawing Sheets

FOLDING PROTECTIVE SHIELDS

STATEMENT OF GOVERNMENT INTEREST

The inventions described herein may be manufactured, used and licensed by or for the U.S. Government for U.S. Government purposes.

BACKGROUND OF THE INVENTION

The invention relates in general to protective shields and in particular to shields for protection from ballistic threats.

Some mounted machine guns and artillery pieces may be equipped with metal armor plates to protect the gunners from sniper fire and shrapnel from explosions. Some gun shields may be improvised in the field using salvaged metal plates. In the Vietnam War, the crews of some armored fighting vehicles and PT Boats would affix metal plates to their machine guns. After the Vietnam War, gun shields fell out of widespread use.

Modern battlegrounds are filled with weapon fire. The weapon fire presents a grave risk to soldiers who expose themselves to fire upon the enemy. The weapon fire may include incoming fire from elevated, precision-fire weapons, and ground-born threats, such as mines and improvised explosive devices. In particular, many casualties are hit in areas not protected by body armor or helmets, such as the neck or face. A disadvantage of gun shields is that they may limit the visibility of the user to the front. In the case of vehicle-mounted guns, gun shields may also adversely affect the performance of tasks other than firing a gun.

Military tanks, such as the Abrams tank, may include a turret with one or more hatches. On the Abrams tank, one of the turret hatches is located at the loader's weapon station. Mounted adjacent the loader's hatch may be a weapon, such as a 7.62 mm rifle. The weapon may be mounted with a skate mount. When using the loader's weapon, the weapon user may be vulnerable to enemy fire. A need exists for a protective shield for the operator of the weapon at the loader's station.

SUMMARY OF THE INVENTION

It is an object of the invention to provide a folding protective shield.

It is another object of the invention to provide a folding protective shield configured for the loader's weapon station of a tank.

One aspect of the invention may be a protective folding shield apparatus for mounting to a rail of a vehicle. The apparatus may include a generally rectangular shield, a base stand fixed to a first side of the shield, a shim fixed to the first side of the shield and spaced apart from the base stand, a hinge fixed to the base stand and the shim, a base fixed to the base stand, a pair of latch bases fixed to the base adjacent a second side of the shield, a pair of latch uprights fixed to the second side of the shield, and a plurality of clamps fixed to the base. The rail may be disposed between the clamps and the base. In a substantially vertical position of the generally rectangular shield, the pair of latch uprights may be removably fixed to respective ones of the latch bases.

The base stand may include a tab inserted in a tab opening in the base. The apparatus may further include a spacer lip disposed beneath the base and on the same side of the base as the first side of the shield. Each latch base may include a boss inserted in a boss opening in the base. The latch uprights may be removably fixed to the latch bases using pins. In a substantially horizontal position, the latch uprights may not be fixed to the latch bases.

The clamps may include threaded openings and the clamps may be fixed to the base with threaded fasteners. The base may be arcuate.

Another aspect of the invention may be an armor kit for a tank. The armor kit may include a generally rectangular shield, a base stand fixed to a first side of the shield, a shim fixed to the first side of the shield and spaced apart from the base stand, a hinge fixed to the base stand and the shim, a base fixed to the base stand, a pair of latch bases fixed to the base adjacent a second side of the shield, and a pair of latch uprights fixed to the second side of the shield. In a substantially vertical position of the generally rectangular shield, the pair of latch uprights may be removably fixed to respective ones of the latch bases.

The armor kit may further include a plurality of clamps for fixing the base to a rail and a hatch latch. The hatch latch may include a base, an arm support fixed to the base, and an arm pivotally fixed in the arm support. The arm of the hatch latch may include an upper pin and a lower pin.

A further aspect of the invention may be an armor kit for a tank wherein a hatch spacer is used in place of the hatch latch. The hatch spacer may include a generally planar base, an upright portion, and a generally planar support surface.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A folding protective shield in accordance with the invention may be used wherever protection is needed. In one embodiment, the protective shield may be used at the loader's weapon station on an M1 Abrams tank. The protective shield may provide cover, concealment, and ballistic protection for the operator at the M1 loader's weapon station. The protective shield may be hinged. The protective shield may be folded down for tasks such as, for example, commander's weapon reloading, ammunition cross-leveling and crew evacuation.

The protective shield may be bolted to locations at the loader's weapon station. Some shields may include windows, and some may not. Combinations of windowed and windowless shields may be used, depending on the desired configuration. One advantage of the protective shields may be that permanent modifications to the vehicle on which the shields are mounted is not required.

Figure 1:
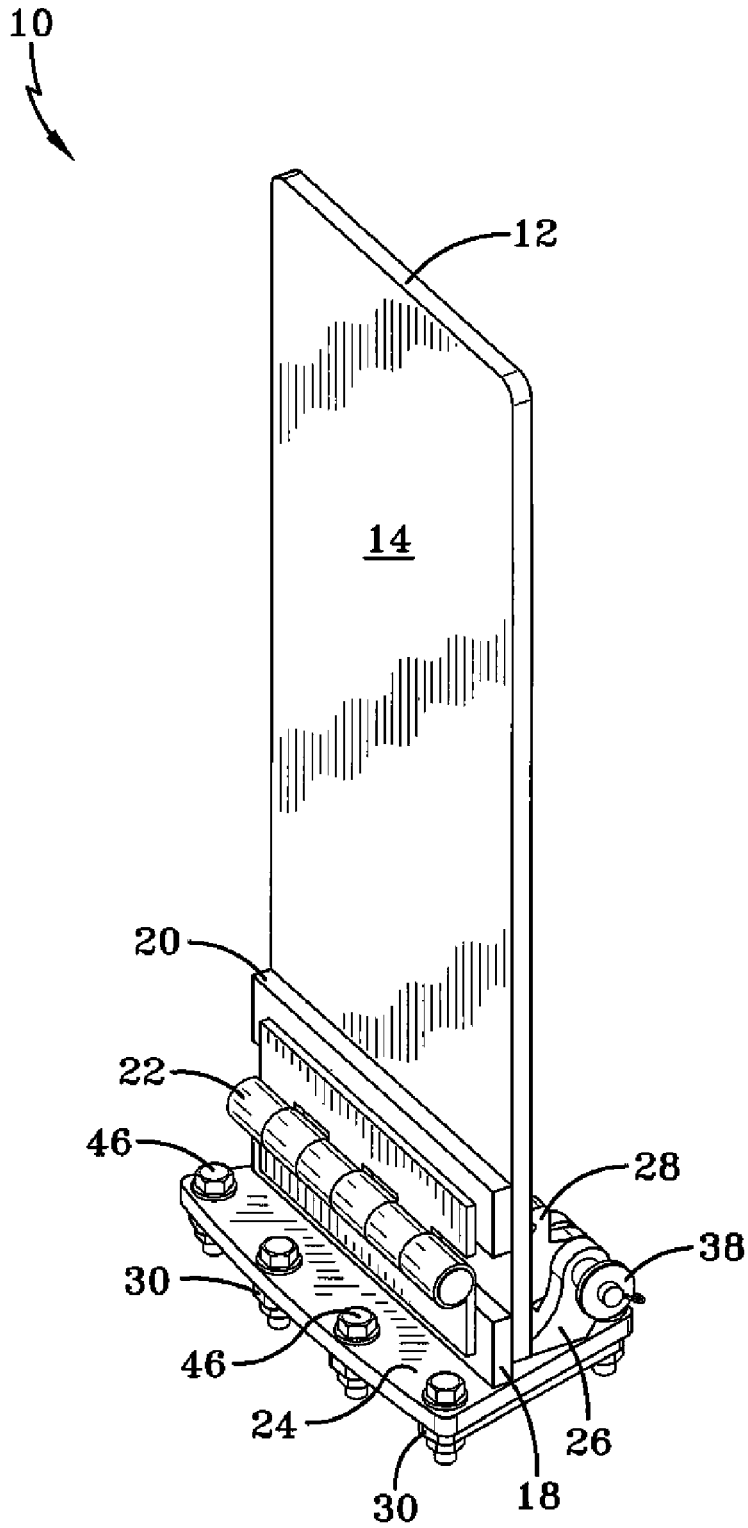
FIG. 1 is a perspective view of one embodiment of a folding protective shield.
Figure 2:
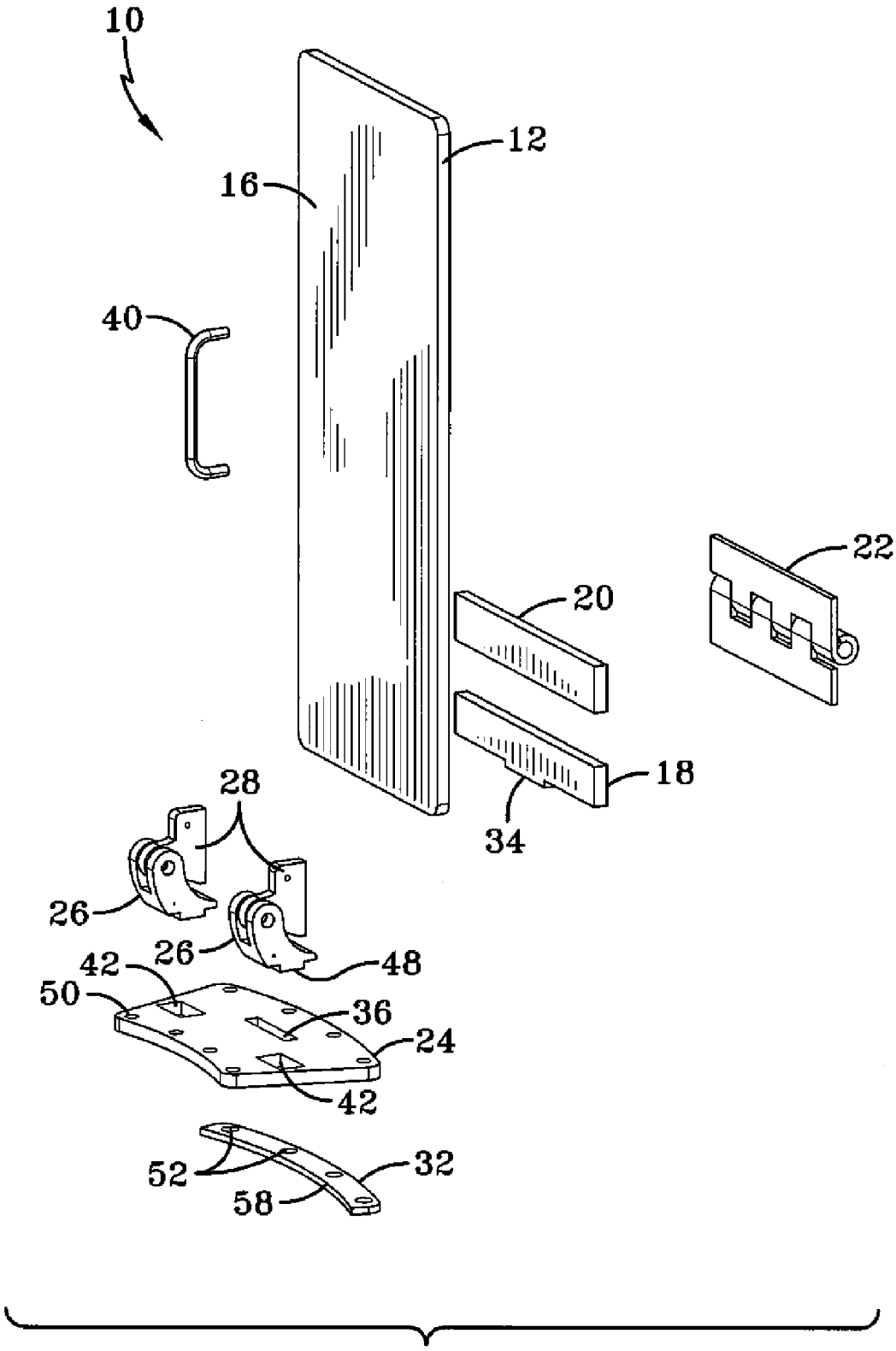
FIG. 2 is an exploded view of FIG. 1, looking from the opposite side.
Figure 3C:
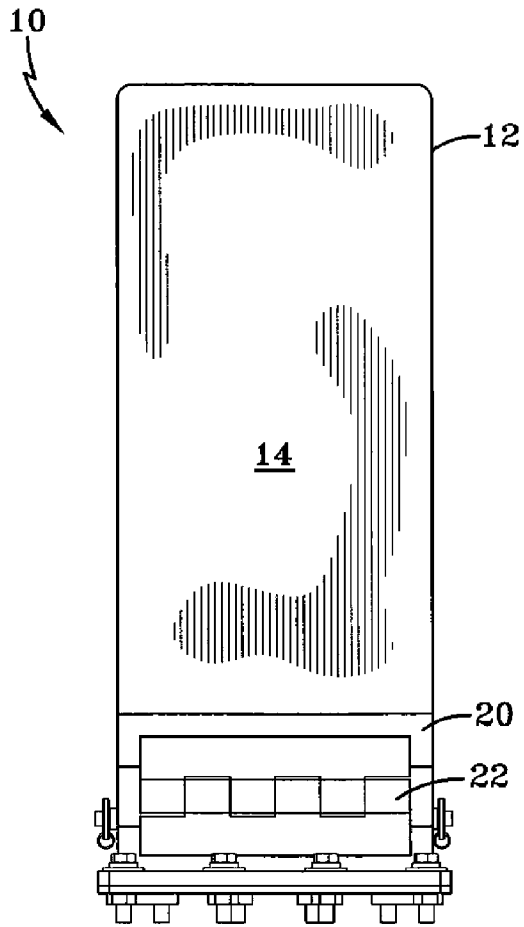
FIGS. 3A-C are front, side, and rear views, respectively, of the shield of FIG. 1.
Figure 3B:
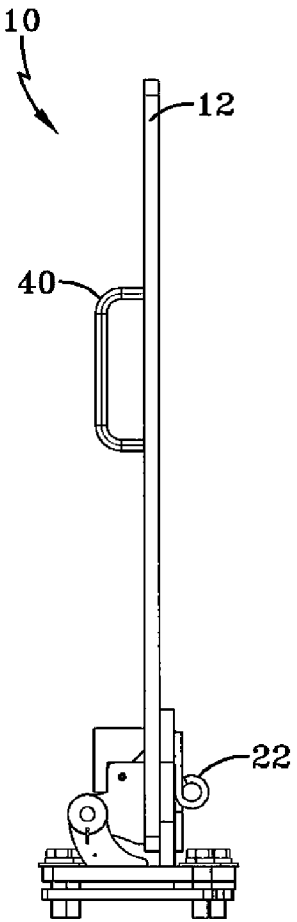
Figure 3A:
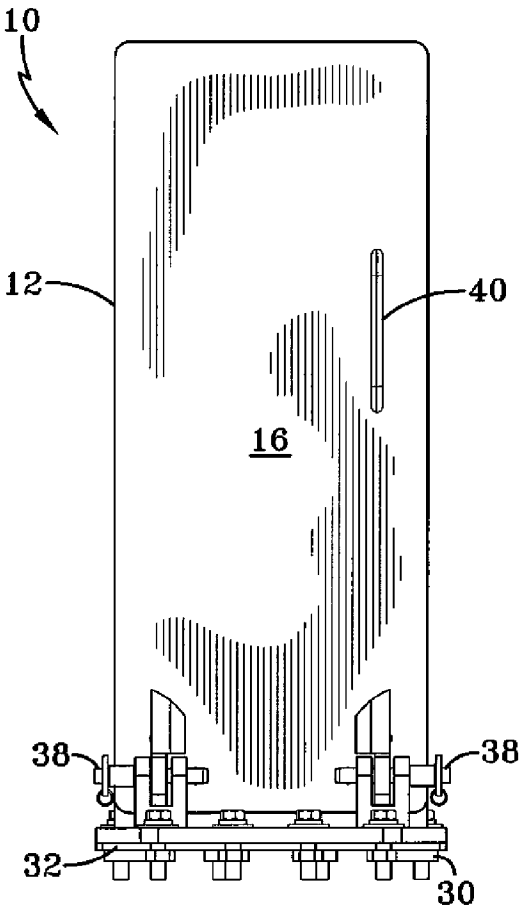

FIG. 1 is a perspective view of one embodiment of a folding protective shield apparatus 10. FIG. 2 is an exploded view of FIG. 1. FIGS. 3A-C are front, side, and rear views, respectively, of the folding apparatus shield 10 of FIG. 1. A protective folding shield apparatus 10 for mounting to a rail 200 (FIG. 7) of a vehicle may include a generally rectangular shield 12 having a first side 14 and a second side 16. The generally rectangular shield 12 may be substantially planar, that is, flat.

A base stand 18 may be fixed to the first side 14 of the shield 12 by, for example, welding. A generally rectangular shim 20 may be fixed to the first side 14 of the shield 12 by, for example, welding. Shim 20 may be spaced apart from the base stand 18. A hinge 22 may be fixed to the base stand 18 and the shim 20 by, for example, welding. A base 24 may be fixed to the base stand 18. Base 24 may be arcuate. For example, base 24 may have a generally circular curvature. Base stand 18 may include a tab 34 that may be inserted in a tab opening 36 in the base 24.

Figure 4:
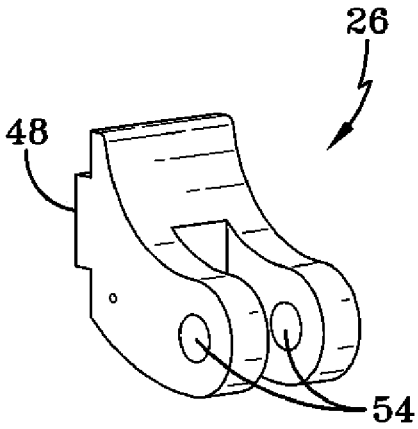
FIG. 4 is a perspective view of a latch base.
Figure 5:
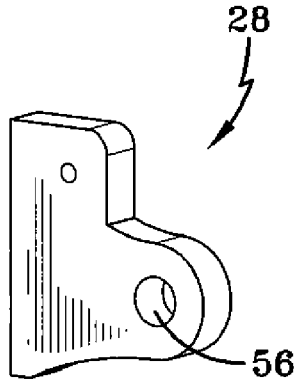
FIG. 5 is a perspective view of a latch upright.

A pair of latch bases 26 (FIG. 4) may be fixed to the base 24 adjacent the second side 16 of the shield 12. A pair of latch uprights 28 (FIG. 5) may be fixed to the second side 16 of the shield 12. In a substantially vertical position of the generally rectangular shield 12, as illustrated in FIG. 1, the pair of latch uprights 28 may be removably fixed to respective ones of the latch bases 26. The latch uprights 28 may be removably fixed to the latch bases 26 using quick-release pins 38. Pins 38 may be inserted in openings 54 in latch bases 26 and openings 56 in latch uprights 28. The pins 38 may be removed and the shield 12 rotated to a substantially horizontal position (not shown). Each latch base 26 may include a boss 48 that may be inserted in a boss opening 42 in the base 24.

Figure 6:
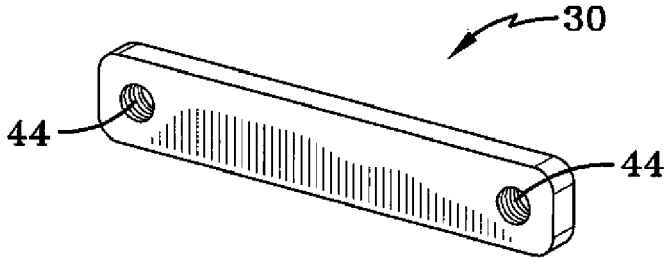
FIG. 6 is a perspective view of a clamp.

A clamp 30 (FIG. 6) may include threaded openings 44 at its opposite ends. Clamps 30 may be used to fix the base 24 to a structure, for example, a rail 200 (FIG. 7) of a vehicle. The rail 200 may be disposed between the clamps 30 and the base 24. Threaded fasteners 46 may be inserted in openings 50 in base 24 and threaded into threaded openings 44 in clamps 30. Thus, the width of the rail 200 or other structure may be less than the distance between the openings 44 in clamps 30.

A spacer lip 32 may be disposed beneath the base 24 on a same side of the base 24 as the first side 14 of the shield 12. Spacer lip 32 may include fastener openings 52 for fasteners 46. Spacer lip 32 may be placed adjacent base 24, with the mounting structure, for example, a rail 200, disposed between the spacer lip 32 and one end of the clamps 30. The spacer lip 32 may be used to more easily determine a proper radial position of the apparatus 10.

In the embodiment of FIG. 1, the generally rectangular shield 12 does not include a window opening or window. A handle 40 (FIG. 2) may be fixed to the second side 16 of the shield 12. The generally rectangular shield 12 may be made of, for example, steel. A thickness of the generally rectangular shield 12 may be, for example, about 0.50 inches. In addition to providing ballistic protection, the windowless shield 12 may be helpful on the outboard side of the loader's hatch for other reasons. For example, the solid steel surface of the shield 12 may provide a helpful work surface for transferring ammunition between vehicles.

Figure 7:
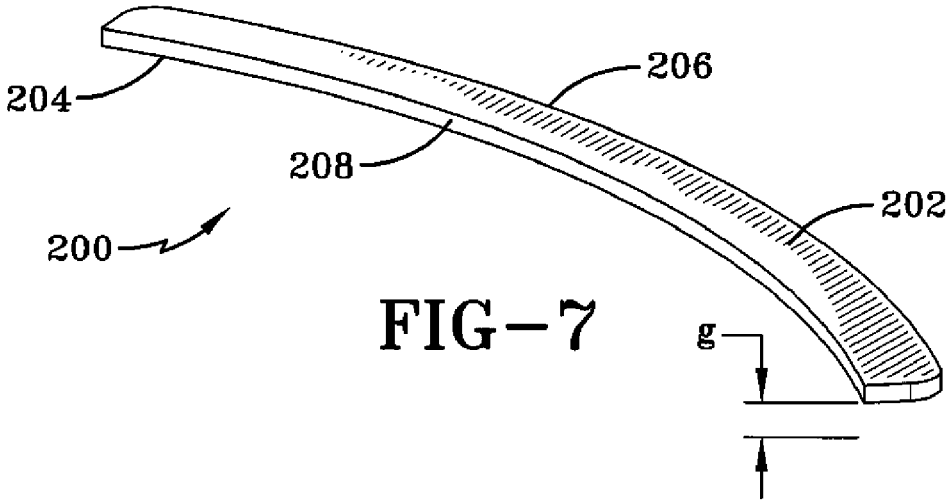
FIG. 7 is a perspective view of a portion of an exemplary mounting rail.

FIG. 7 is a perspective view of a portion of an exemplary mounting rail 200 for apparatus 10. Rail 200 may include an upper surface 202, a lower surface 204, an outboard edge 206, and an inboard edge 208. A bottom surface of the base 24 (FIG. 2) of apparatus 10 may rest on the upper surface of rail 200. The inner edge 58 of spacer lip 32 (FIG. 2) may abut the outboard edge 206 of rail 200. The spacer lip 32 may be helpful for radially positioning the apparatus 10 with respect to the rail 200. A gap g (FIG. 7) may be present between the lower surface 204 of rail 200 and the top surface of the vehicle (not shown) to which the apparatus 10 is attached. The clamps 30 are disposed in the gap g and bear against the lower surface 204 of rail 200.

Figure 8:
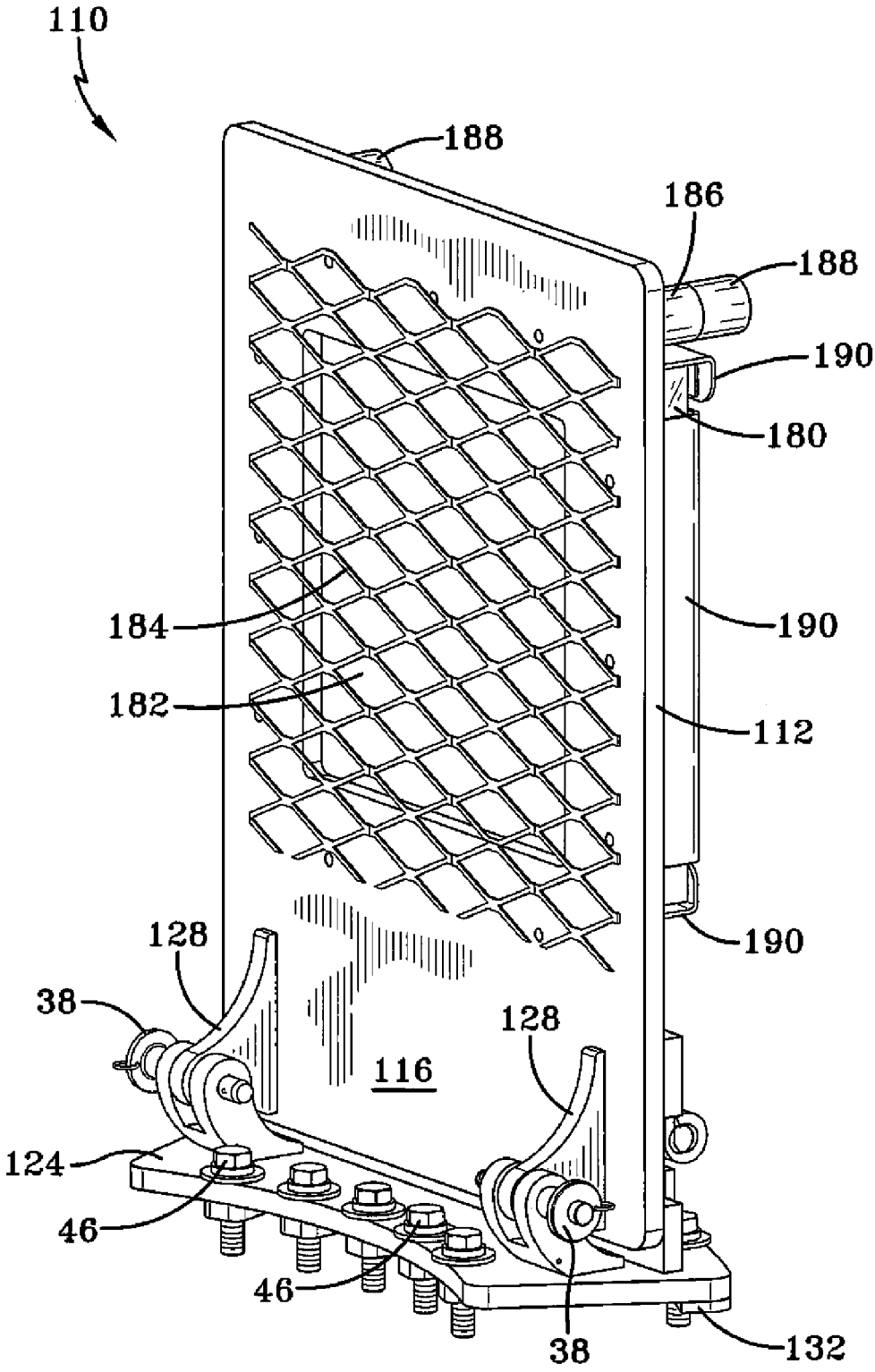
FIG. 8 is a perspective view of another embodiment of a folding protective shield.
Figure 9A:
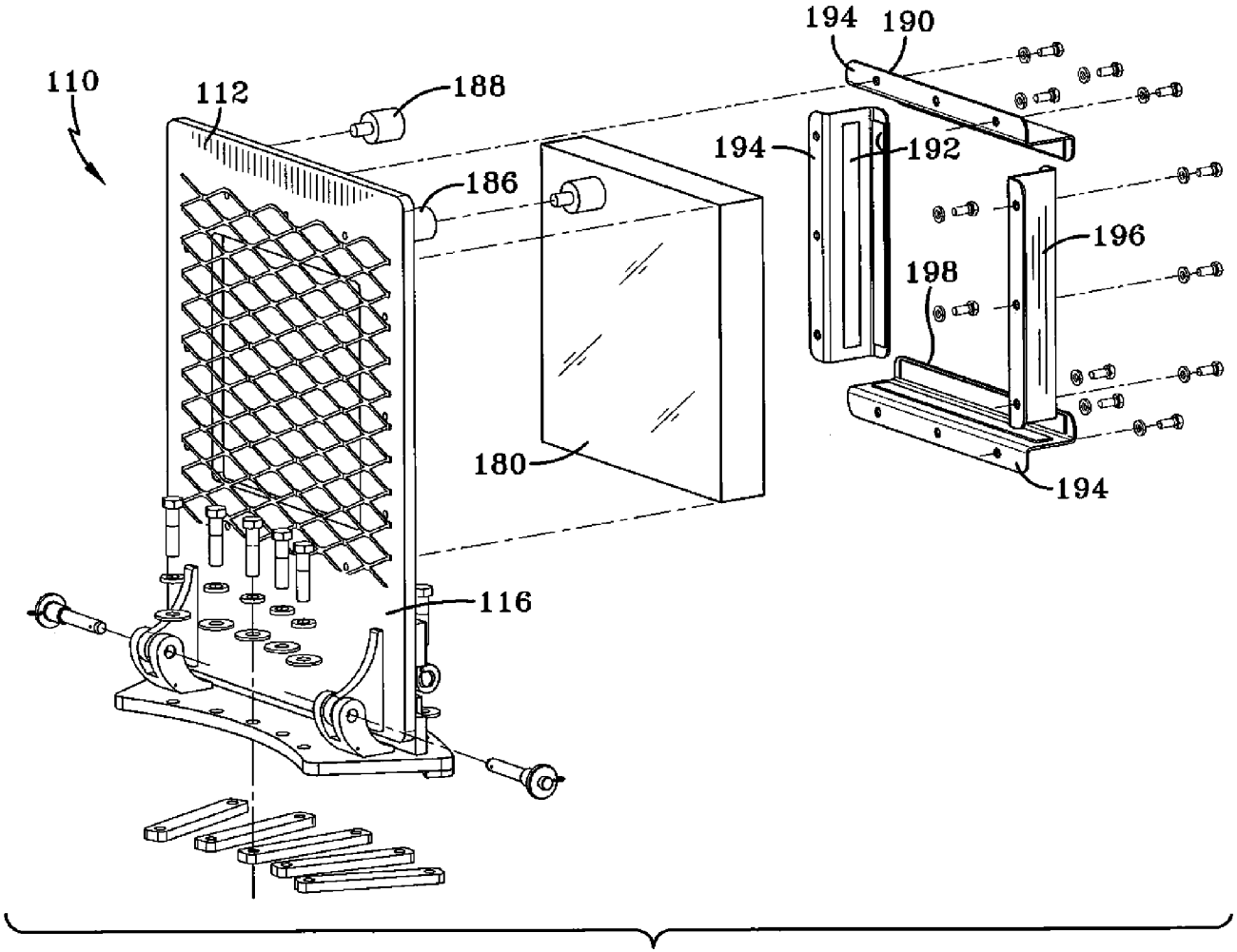
FIGS. 9A and 9B are exploded views of FIG. 8.
Figure 9B:
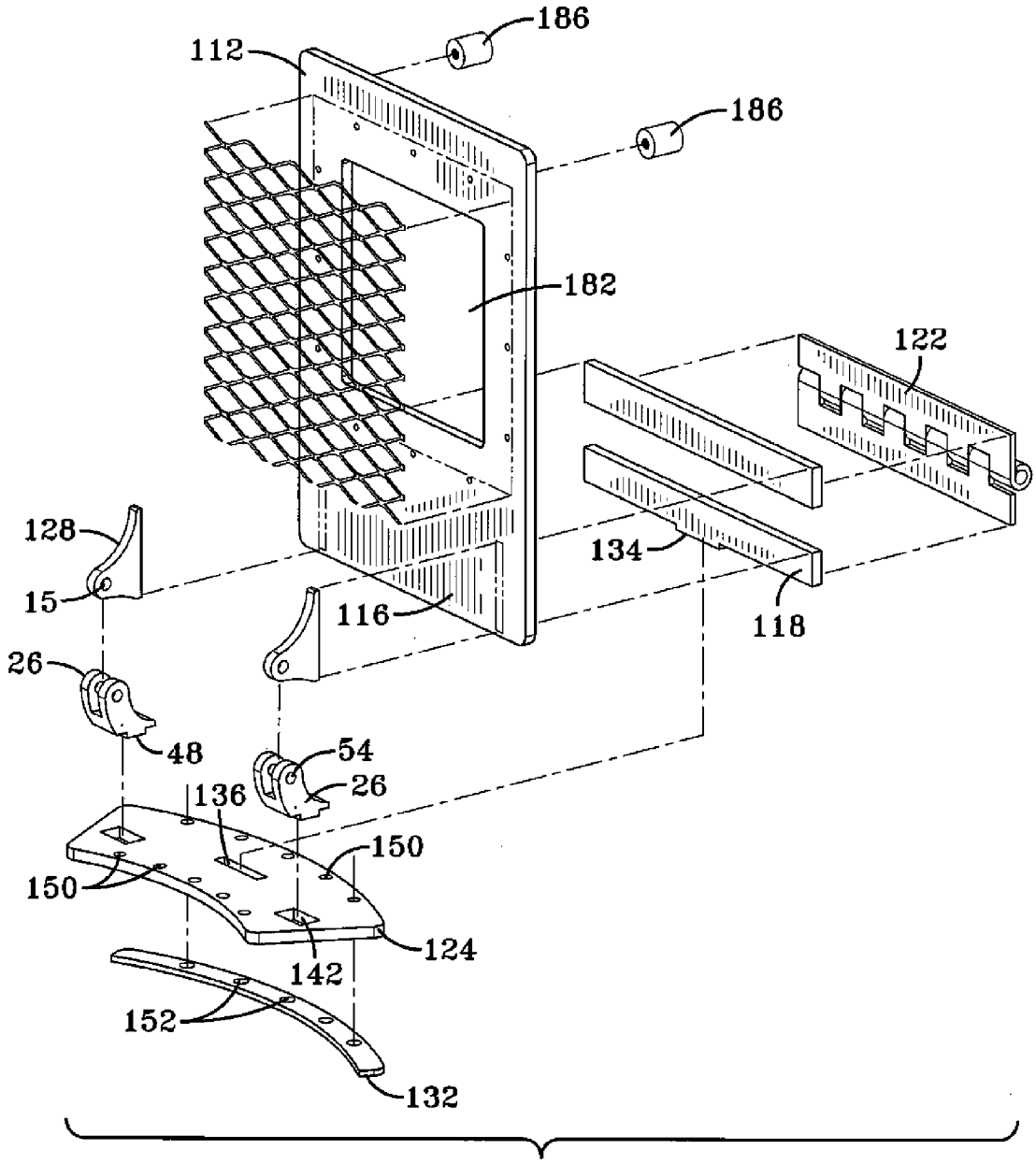
Figure 10C:
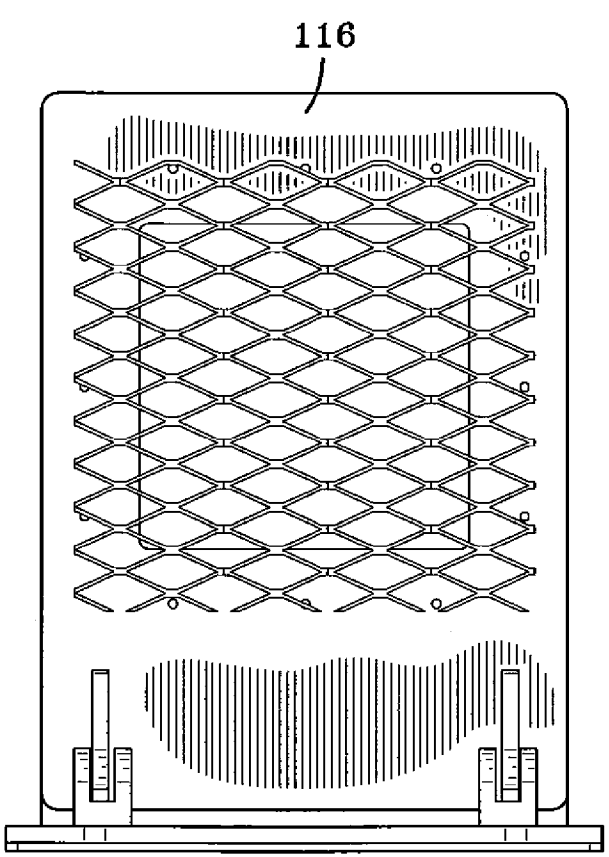
FIGS. 10A-C are front, side, and rear views, respectively, of the shield of FIG. 8.
Figure 10B:
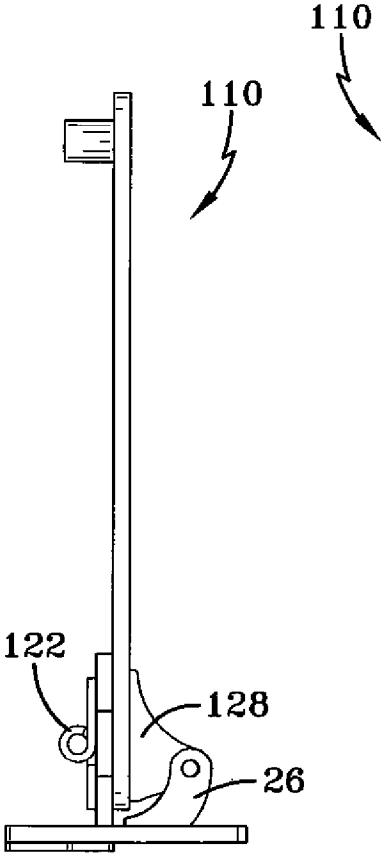
Figure 10A:
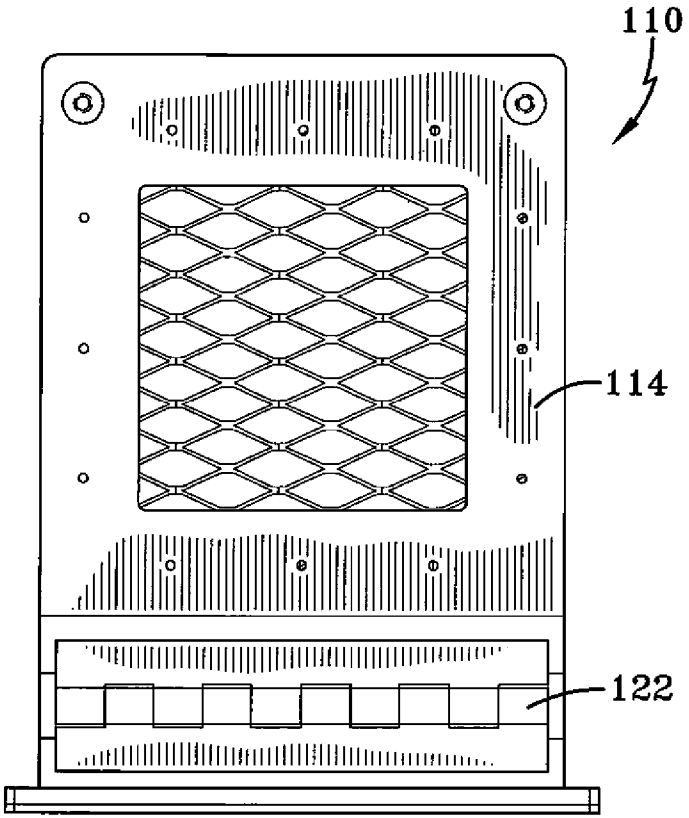

FIG. 8 is a perspective view of another embodiment of a folding protective shield apparatus 110. FIGS. 9A and 9B are exploded views of FIG. 8. FIGS. 10 are front, side, and rear views, respectively, of the shield apparatus 110 of FIG. 8. A protective folding shield apparatus 110 for mounting to a rail of a vehicle may include a generally rectangular shield 112 having a first side 114 and a second side 116. The generally rectangular shield 112 may be substantially planar, that is, flat.

A base stand 118 may be fixed to the first side 114 of the shield 112 by, for example, welding. A generally rectangular shim 120 may be fixed to the first side 114 of the shield 112 by, for example, welding. Shim 120 may be spaced apart from the base stand 118. A hinge 122 may be fixed to the base stand 118 and the shim 120 by, for example, welding. A base 124 may be fixed to the base stand 118. Base 124 may be arcuate. For example, base 124 may have a generally circular curvature. Base stand 118 may include a tab 134 that may be inserted in a tab opening 136 in the base 124.

Figure 11:
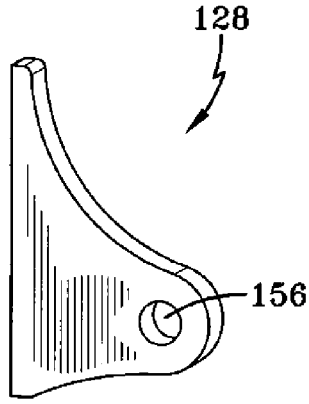
FIG. 11 is a perspective view of another embodiment of a latch upright.

A pair of latch bases 26 (FIG. 4) may be fixed to the base 124 adjacent the second side 116 of the shield 112. A pair of latch uprights 128 (FIG. 11) may be fixed to the second side 116 of the shield 112. In a substantially vertical position of the generally rectangular shield 112, as illustrated in FIG. 8, the pair of latch uprights 128 may be removably fixed to respective ones of the latch bases 26. The latch uprights 128 may be removably fixed to the latch bases 26 using quick-release pins 38. Pins 38 may be inserted in openings 54 in latch bases 26 and openings 156 in latch uprights 128. The pins 38 may be removed and the shield 112 rotated to a substantially horizontal position (not shown). Each latch base 26 may include a boss 48 that may be inserted in a boss opening 142 in the base 124.

A clamp 30 (FIG. 6) may include threaded openings 44 at its opposite ends. Clamps 30 may be used to fix the base 124 to a structure, for example, the rail 200 (FIG. 7) of a vehicle. The rail 200 may be disposed between the clamps 30 and the base 124. Threaded fasteners 46 may be inserted in openings 150 in base 124 and threaded into threaded openings 44 in clamps 30. Thus, the width of the rail 200 or other structure may be less than the distance between the openings 44 in clamps 30.

A spacer lip 132 may be disposed beneath the base 124 on a same side of the base 124 as the first side 114 of the shield 112. Spacer lip 132 may include fastener openings 152 for fasteners 46. Spacer lip 132 may be placed adjacent base 124, with the mounting structure, for example, a rail 200, disposed between the spacer lip 132 and one end of the clamps 30. The spacer lip 132 may be used to more easily determine a proper radial position of the apparatus 110.

Apparatus 110 may be attached to rail 200 (FIG. 7) in a manner similar to that described for apparatus 10.

In the embodiment of FIG. 8, the generally rectangular shield 112 includes a window 180 disposed over a window opening 182 (FIG. 9A) in shield 112. The generally rectangular shield 112 may be made of, for example, steel. A thickness of the generally rectangular shield 112 may be, for example, about 0.50 inches. Window 180 may be made of, for example, laminated ballistic glass. A thickness of window 180 may be, for example, about two inches.

Window 180 may be fixed to shield 112 with generally Z-shaped brackets 190 and fasteners. Surfaces 194 of brackets 190 may bear against the shield 112. Surfaces 196 of brackets 190 may bear against sides of window 180. Surfaces 198 of brackets 190 may bear against a face of window 180. Gasket material 192 may be used on those surfaces of brackets 190 that may contact the window 180, such as surfaces 196 and 198.

A wire mesh 184 may be disposed over window 180 on side 116 of shield 112. Wire mesh 184 may comprise, for example, expanded flattened stainless steel. A pair of bumper spacers 186 may be fixed at the top corners of the side 114 of shield 112. A pair of bumpers 188 may be attached to the respective bumper spacers 186. Bumpers 188 and bumper spacers 186 provide support for shield 112 when it is in a horizontal position and help protect window 180. Bumpers 188 and bumper spacers 186 may be made of, for example, steel.

Figure 12C:
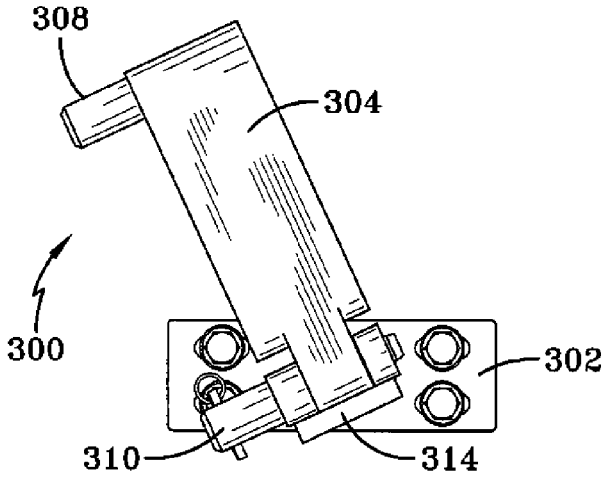
FIGS. 12A, B, and C, are perspective, elevation, and top views, respectively of an embodiment of a hatch latch.
Figure 12B:
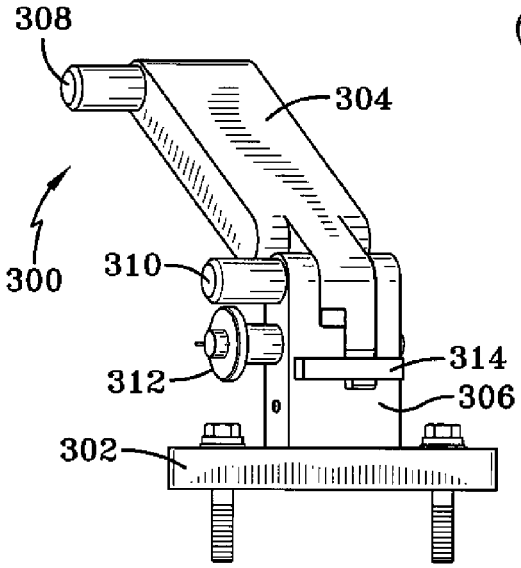
Figure 12A:
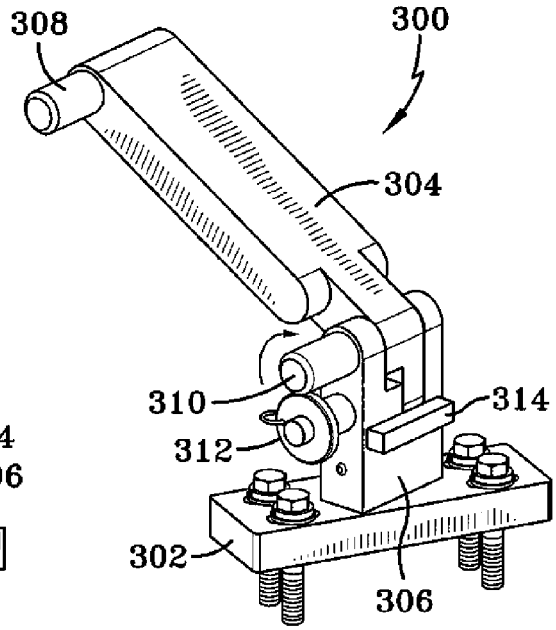

The loader's hatch on the M1A2 Abrams tank may also provide ballistic protection if latched in a suitable orientation. FIG. 12 is a perspective view of an adjustable loader's hatch latch 300 that may be suitable for the loader's hatch on the M1A2 Abrams tank. FIGS. 12B and C are elevation and top views, respectively of the hatch latch 300 of FIG. 12A.

Latch 300 may include a base 302, an arm support 306 fixed to the base 302, and an arm 304 that is pivotally held in arm support 306. Arm 304 includes upper pin 308 and lower pin 310. A quick release pin 312 prevents rotation of arm 304. In the position shown in FIGS. 12A, B, and C, the arm 304 is locked in position by quick release pin 312. This locked position enables the loader's hatch to be rotated about ninety degrees from a closed position (i.e., the hatch will be substantially vertical) and latch against the upper pin 308 of the arm 304. The upright position of the loader's hatch provides additional cover, concealment and protection for the operator at the loader's station.

If it is desired to secure the loader's hatch in a completely open position (substantially horizontal), then the quick release pin 312 is removed and the arm 304 is rotated clockwise, as shown by the arrow in FIG. 12A, until the arm 304 contacts stop member 314. The quick release pin 312 is then re-inserted and the loader's hatch is opened until it latches against lower pin 310.

The structure of the loader's hatch on the M1A1 differs from the M1A2 so the latch 300 may not be useful on the M1A1. On the M1A1 tank, the fully open position of the loader's hatch may be only about 22 degrees from the horizontal. If the angle between the hatch and the horizontal were increased, the hatch would present a larger obstacle to incoming fire. A hatch spacer may position the loader's hatch at a higher angle, thus providing more protection.

Figure 13:
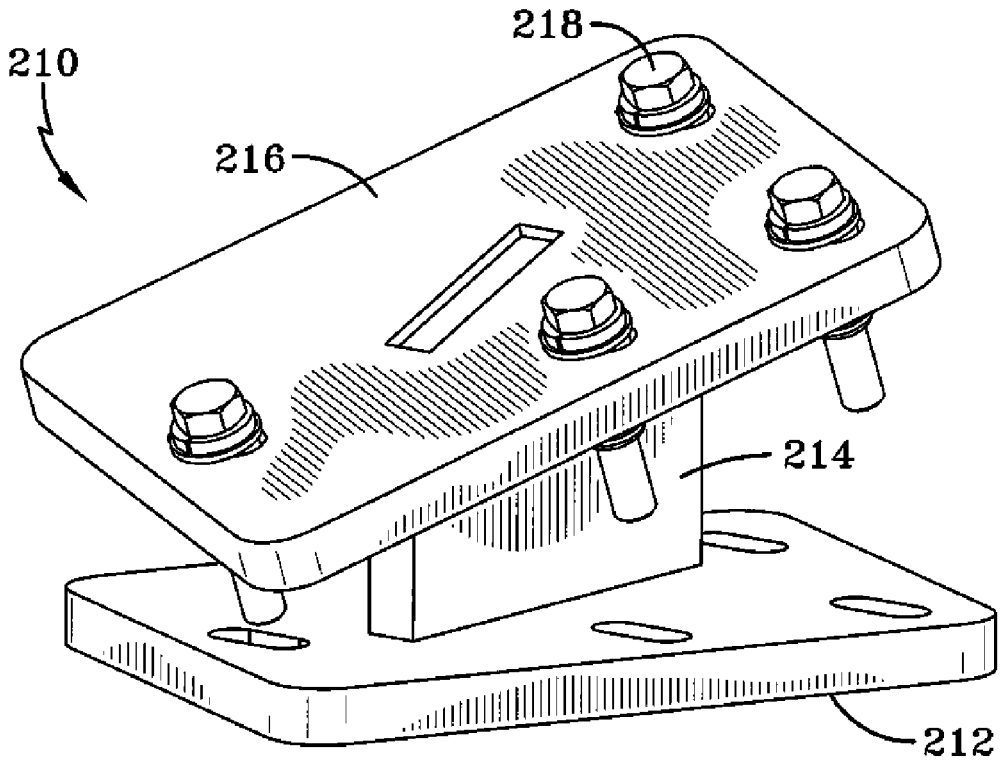
FIG. 13 is a perspective view of a hatch spacer.
Figure 14:
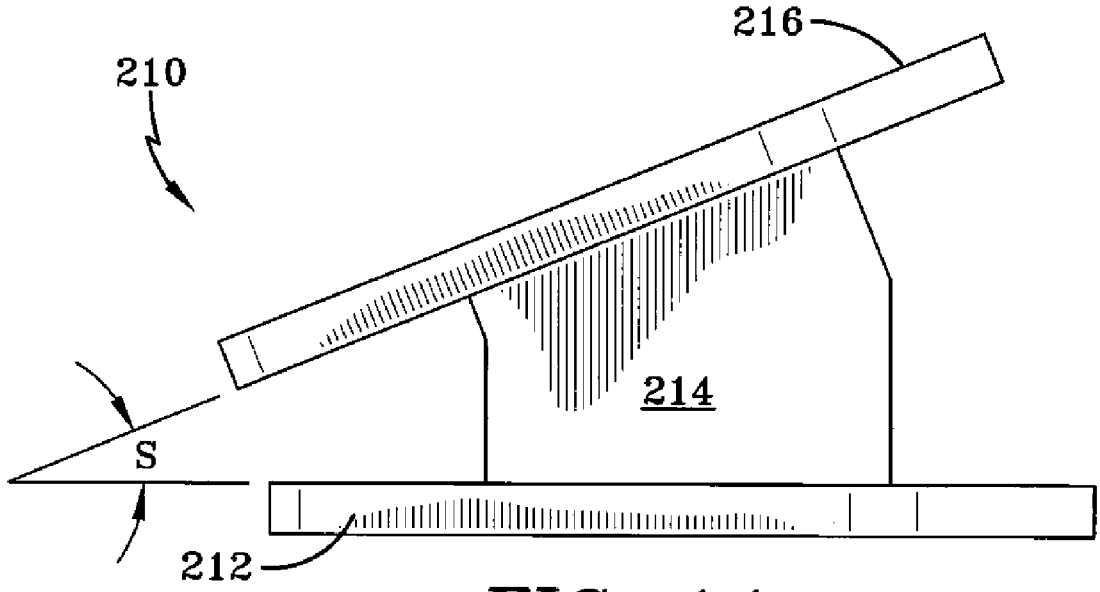
FIG. 14 is a side view of the hatch spacer of FIG. 13.

FIG. 13 is a perspective view of an embodiment of a hatch spacer 210. FIG. 14 is a side view of the hatch spacer 210 of FIG. 13. Hatch spacer 210 may include a generally planar base 212 for attachment to the vehicle, an upright portion 214, and a generally planar support surface 216. An existing hatch latch (not shown) may be fixed to the support surface 216 with fasteners 218. In this way, the hatch latch is elevated by an additional angle s (FIG. 14). Angle s may be, for example, about 22 degrees.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A protective folding shield apparatus for mounting to a rail of a vehicle, comprising:
- a generally rectangular shield;
- a base stand fixed to a first side of the shield;
- a shim fixed to the first side of the shield and spaced apart from the base stand;
- a hinge fixed to the base stand and the shim;
- a base fixed to the base stand;
- a pair of latch bases fixed to the base adjacent a second side of the shield;
- a pair of latch uprights fixed to the second side of the shield wherein, in a substantially vertical position of the generally rectangular shield, the pair of latch uprights are removably fixed to respective ones of the latch bases; and
- a plurality of clamps fixed to the base wherein the rail is disposed between the clamps and the base.

2. The apparatus of claim 1, wherein the base stand includes a tab inserted in a tab opening in the base.

3. The apparatus of claim 1, further comprising a spacer lip disposed beneath the base and on a same side of the base as the first side of the shield.

4. The apparatus of claim 1, wherein each latch base includes a boss inserted in a boss opening in the base.

5. The apparatus of claim 1, wherein the latch uprights are removably fixed to the latch bases using pins.

6. The apparatus of claim 1, wherein, in a substantially horizontal position, the latch uprights are not fixed to the latch bases.

7. The apparatus of claim 1, further comprising a handle fixed to the second side of the shield.

8. The apparatus of claim 1, wherein the generally rectangular shield does not include a window.

9. The apparatus of claim 8, wherein the generally rectangular shield comprises steel.

10. The apparatus of claim 9, wherein a thickness of the generally rectangular shield is about 0.50 inches.

11. The apparatus of claim 1, wherein the clamps include threaded openings and the clamps are fixed to the base with threaded fasteners.

12. The apparatus of claim 1, further comprising a window opening in the generally rectangular shield and a window disposed over the window opening.

13. The apparatus of claim 1, wherein the generally rectangular shield is substantially planar.

14. The apparatus of claim 13, wherein the base is arcuate.

15. The apparatus of claim 12, further comprising a wire mesh disposed over the window.

16. The apparatus of claim 12, further comprising generally Z-shaped brackets for fixing the window to the generally rectangular shield.

17. An armor kit for a tank, comprising:
- a generally rectangular shield;
- a base stand fixed to a first side of the shield;
- a shim fixed to the first side of the shield and spaced apart from the base stand;
- a hinge fixed to the base stand and the shim;
- a base fixed to the base stand;
- a pair of latch bases fixed to the base adjacent a second side of the shield;

a pair of latch uprights fixed to the second side of the shield wherein, in a substantially vertical position of the generally rectangular shield, the pair of latch uprights are removably fixed to respective ones of the latch bases;

a plurality of clamps for fixing the base to a rail; and a hatch latch comprising a base, an arm support fixed to the base, and an arm pivotally fixed in the arm support.

18. The kit of claim 17, wherein the arm of the hatch latch includes an upper pin and a lower pin.

19. An armor kit for a tank, comprising:

a generally rectangular shield;

a base stand fixed to a first side of the shield;

a shim fixed to the first side of the shield and spaced apart from the base stand;

a hinge fixed to the base stand and the shim;

a base fixed to the base stand;

a pair of latch bases fixed to the base adjacent a second side of the shield;

a pair of latch uprights fixed to the second side of the shield wherein, in a substantially vertical position of the generally rectangular shield, the pair of latch uprights are removably fixed to respective ones of the latch bases;

a plurality of clamps for fixing the base to a rail; and a hatch spacer comprising a generally planar base, an upright portion, and a generally planar support surface.

20. The kit of claim 19, wherein the generally planar support surface is angled at about twenty-two degrees with respect to the generally planar base.

* * * * *